US005139092A

United States Patent [19]

Boyle

[11] Patent Number: 5,139,092

[45] Date of Patent: Aug. 18, 1992

[54] QUICK CHANGE TORQUE MULTIPLIER ADAPTOR

[75] Inventor: Terrence M. Boyle, Seattle, Wash.

[73] Assignee: The Boeing Company, Seattle, Wash.

[21] Appl. No.: 565,772

[22] Filed: Aug. 10, 1990

[51] Int. Cl.[5] ..... B25B 13/50

[52] U.S. Cl. ..... 173/1; 173/32; 173/37; 29/407

[58] Field of Search ..... 173/31, 1, 33, 32, 37; 81/57.24, 57.35, 57.4; 248/674, 223.2, 231.5, 222.3; 29/281.6, 407

[56] References Cited

U.S. PATENT DOCUMENTS

| | | | |
|---|---|---|---|
| 644,079 | 2/1900 | Huber | 81/467 |
| 2,736,219 | 2/1956 | May | 81/467 |
| 3,838,487 | 10/1974 | Maeda | 29/200 P |
| 3,967,687 | 7/1976 | Fowler | 173/32 |
| 3,969,961 | 7/1976 | Amoroso | 81/467 |
| 4,215,599 | 8/1980 | Batchelder et al. | 81/467 |
| 4,548,103 | 10/1985 | Orban | 81/53.2 |
| 4,791,838 | 12/1988 | Bickford et al. | 81/467 |

FOREIGN PATENT DOCUMENTS

| | | | |
|---|---|---|---|
| 1087539 | 8/1960 | Fed. Rep. of Germany | 81/57.24 |
| 2036377 | 1/1972 | Fed. Rep. of Germany | 81/467 |
| 3222161 | 12/1983 | Fed. Rep. of Germany | 81/467 |
| 3805301 | 4/1989 | Fed. Rep. of Germany | 81/467 |
| 2390250 | 1/1979 | France | 29/281.6 |

OTHER PUBLICATIONS

Raymond Engineering, "Operating and Maintenance Manual Torque Wrench Model PD602".

*Primary Examiner*—Mark Rosenbaum
*Assistant Examiner*—John M. Husar
*Attorney, Agent, or Firm*—J. Michael Neary; B. A. Donahue

[57] ABSTRACT

A device for coupling a torque driver to a fastener that is to be driven on a workpiece by the driver, and for coupling the driver housing to the workpiece, has two nesting cylindrical barrels, one of which can be fastened to the driver housing and the other of which can be connected to a reaction structure which is clamped to the workpiece. The two barrels are coupled together for limited rotation relative to each other which facilitates placement of the device on the reaction structure and securing it in place thereon, and also provides a torque path for reaction torque from the driver housing through the two barrels of the device to the reaction structure and thence to the workpiece. The reaction structure has a series of positioning stops that facilitate quick and accurate positioning on the workpiece, and a power operated clamp for securely connecting the reaction structure to the workpiece.

20 Claims, 5 Drawing Sheets

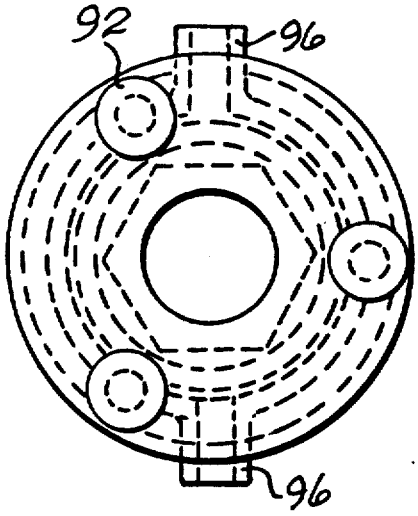
Fig.7
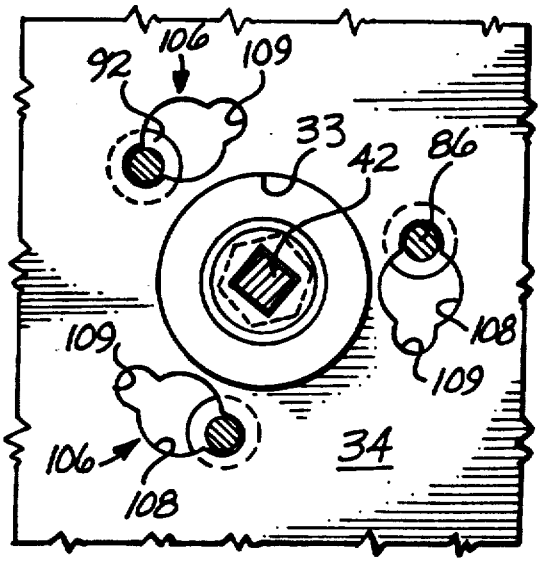
Fig.9
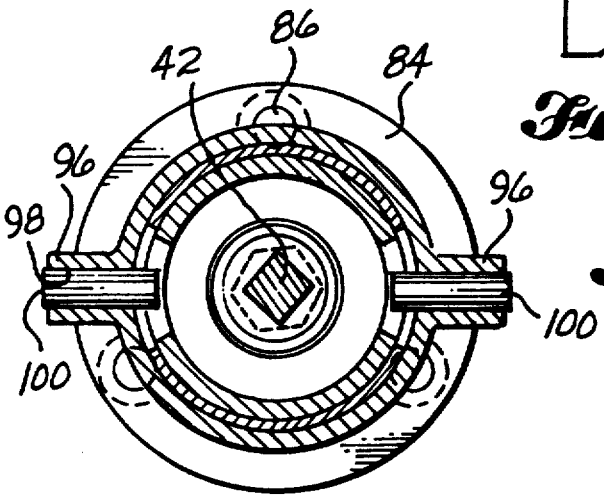
Fig.8
Fig.11
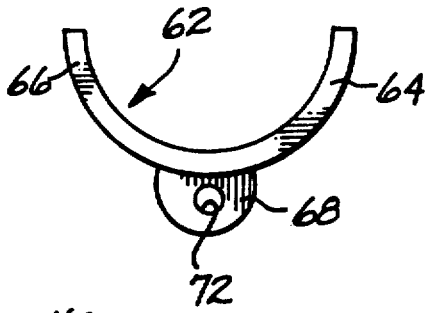
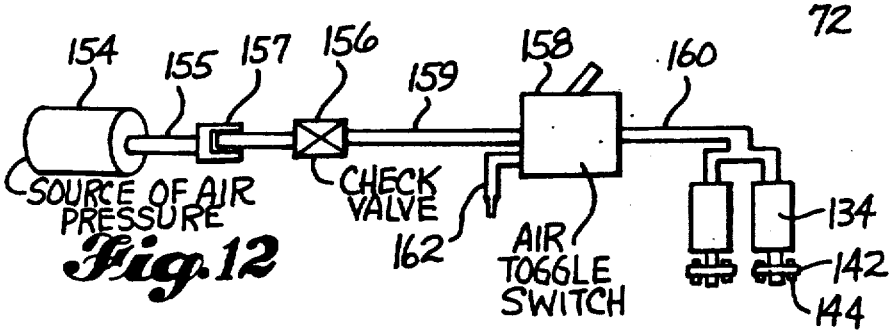
Fig.12

QUICK CHANGE TORQUE MULTIPLIER ADAPTOR

BACKGROUND OF THE INVENTION

This invention relates to devices for coupling a torque driver to a fastener, and more particularly to devices which enable torque from the torque driver to be delivered to a fastener, and for reaction torque from the driver housing to be transmitted to the workpiece.

Large mechanical systems, such as airplanes, often require the use of large threaded fasteners tightened to high torque values, on the order of 350 to 750 foot pounds or higher. Traditionally, these large threaded fasteners have been tightened with the use of a long-handled torque wrench, typically five feet long. The process requires one operator to hold the socket on the fastener and another operator to apply power to the torque wrench by grasping the end of the socket wrench handle and pulling to exert the required torque on the fastener. Normally, the torquing operator can apply only a quarter of a turn or so before he must ratchet the wrench back to its original starting position to apply the next quarter turn. Since the breaking torque is always greater than the dynamic torque, it is the usual experience for the operators to reach the specified torque for that fastener at the beginning of one of the quarter turns. Thus, the actual dynamic torque to the fastener is often somewhat less than that specified by the design.

In certain critical fastening connections, it is necessary to have quality monitors present at the torquing operation to verify that the fasteners are properly torqued, and to gather data used in statistical process control. For those operations, an additional person is required to perform those functions. The use of two or three operators to do the job is thus wasteful of manpower and thereby increases the manufacturing cost.

Use of the hand operated, long-handled torque wrench is a physically taxing and difficult task. It is often operated from a sitting position wherein the operator braces his feet against a convenient foot hold on the floor and reaches forward between his legs with his arms to grasp the handle of the torque wrench, and then pulls the wrench toward him. In other applications, the operator may be required to stand in an awkward position, reaching over equipment that cannot be moved, or in an unbalanced position. These are all strained positions for the operator and risk injury which could cause increased delay and cost in the manufacturing process and personal inconvenience and suffering to the workers.

The concept of "joint relaxation", wherein the torque on a fastener in a joint decreases in the first minute or so after it has been fastened, increases the effort and time required to properly torque the fasteners, because there is no certain indication whether the joint has "relaxed", so the nuts must all be retorqued after several minutes following the initial torquing to ensure that they are at the specified torque.

Naturally, some considerable attention has been applied to improving the process of torquing large fasteners in the manufacture of large mechanical systems Impact wrenches have been studied, but they are noisy, difficult to calibrate, and incapable of delivering the required high torque at the necessary precision. The best solution to date has been the use of a pneumatic or electrical nut driver operating through a torque multiplier fastened to the workpiece. In that arrangement, the torque multiplier is bolted to a separate reaction plate that, in turn, is bolted to the workpiece over the fastener to be torqued, thereby providing a path for transmission of reaction torque exerted by the housing of the torque multiplier through the reaction plate to the workpiece.

This improved process is far superior to the hand operated, long-handled torque wrench in that it can be accomplished by one operator and does not require the use of a manually operated torque wrench. However, it does require a precisely machined reaction plate having a precisely machined hexagonal hole positioned precisely on the reaction plate over the position that will be occupied by the fastener when the reaction plate is bolted to the workpiece. Even with careful machining, the alignment of the torque multiplier with the fastener when the torque multiplier is inserted in the hexagonal hole and bolted to the plate is difficult. In addition, the torque multiplier must be hand held on the reaction plate with one hand while the the screws are inserted from the back side of the reaction plate with the other hand to secure the torque multiplier to the reaction plate. Another difficulty is the placement of the socket on the nut, because the nut may not be visible to the operator, so he must do it by feel. Finally, the torque multiplier must be unbolted and rebolted to the reaction plate for each nut to be tightened because the consequences of an unbolted reaction plate springing loose under high torque loads could be very severe. The bolting and unbolting of a reaction plate for every nut is a time consuming and annoyingly repetitive task.

Thus, there has long been a need in the art for a device for attaching a power operated torque multiplier to a workpiece, which device can be easily attached and detached in a simple, fast and easy motion, and wherein the socket on the drive rod of the torque multiplier can be fitted over the nut in full view of the operator, and without the necessity of simultaneously supporting the heavy torque multiplier with one hand while attempting to align the socket with the nut with the other hand.

SUMMARY OF THE INVENTION

Accordingly, it is an object of this invention to provide a device for coupling a torque driver to a workpiece which can be quickly, easily and simply connected and disconnected without long fatiguing hand held support of the torque multiplier. It is another object of this invention to provide a device for coupling a torque multiplier to a workpiece which can be operated easily and quickly by one operator and in which a series of fasteners can be quickly torqued by the operator.

It is yet another object of the invention to provide a device for coupling a torque multiplier to a workpiece which facilitates the application of dynamic torque to the fastener up to the specified level, and facilitates the recording of the torque applied to the nut so that uniform torque can be applied to all the fasteners to hold that part to the mechanical system and statistical process control techniques can be applied to that phase of the manufacture.

A further object of the invention is to provide a reaction structure for use with a torque multiplier for exerting high torque on a fastener, wherein the reaction structure can be machined with fast and inexpensive processes not requiring extreme precision and which facilitate quick and easy alignment of the torque multiplier over the fastener.

It is yet still another object of the invention to provide a process for tightening a fastener to a specified torque which is uniform and repeatable, and which relieves the operator of tiring, frustrating and time consuming tasks while accomplishing the task in minimum time with no physical fatigue and little frustration or boredom in the task.

These and other objects of the invention are attained in a device for coupling a torque driver to a fastener, and for coupling a housing of the driver to the workpiece on which the fastener is being driven. The device has two nesting cylindrical barrels that can be fastened to the driver housing and to a reaction structure clamped to the workpiece. The two barrels are coupled for limited rotation relative to each other which facilitates placement of the device on the reaction structure and securing it in place thereon, and also provides a torque path for reacting torque from the driver housing through the two barrels of the device to the reaction structure and thence to the workpiece The reaction structure has a series of positioning stops that facilitate quick and accurate positioning on the workpiece, and a power operated clamp for securely connecting the reaction structure to the workpiece. A simple round hole at each fastener position and a pattern of quick-disconnect keyhole slots around the holes facilitates quick and easy connection of the torque multiplier to the reaction plate, and self-alignment of the torque multiplier over the fasteners.

DESCRIPTION OF THE DRAWINGS

These and other objects of the invention will become more apparent upon reading the following description of the preferred embodiment in conjunction with the drawings, wherein:

FIG. 7 is a plan view from the bottom of the adaptor shown in FIG. 2;

FIG. 8 is a sectional plan view along lines 8—8 in FIG. 3;

FIG. 9 is a sectional plan view along lines 9—9 in FIG. 3;

FIG. 11 is a plan view of the fork used to hold the adaptor to the torque multiplier, as shown in FIGS. 2 and 3; and FIG. 12 is a schematic view of a pneumatic circuit for controlling the clamp air cylinders on the reaction structure shown in FIG. 10.

DESCRIPTION OF THE PREFERRED EMBODIMENT

Figure 1:
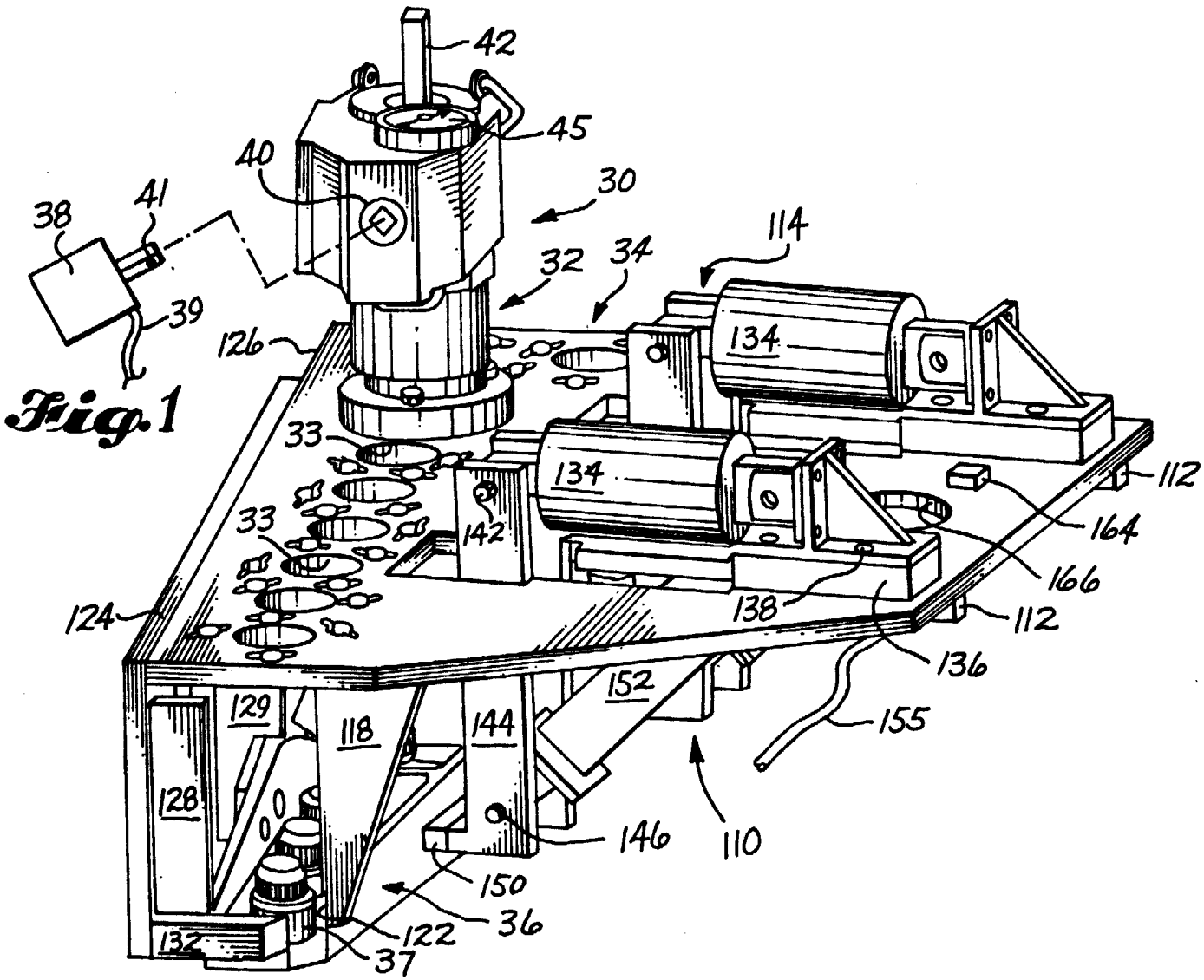
FIG. 1 is a perspective view of the adaptor of this invention in use with a torque multiplier and mounted on a reaction plate of this invention.

Turning now to the drawings, wherein like reference characters designate identical or corresponding parts, and more particularly to FIG. 1 thereof, a torque multiplier 30 is shown mounted over one of several holes 33 on an adaptor 32 which in turn is mounted on a reaction plate 34 secured to a workpiece 36, in this case a terminal fitting which is bolted to a wing spar. The terminal fitting is a part of the hardware for mounting a wing to a wing box in an airplane fuselage, and is bolted to the wing spar with one inch diameter titanium bolts which are tightened to a torque of about 650 foot pounds. A pneumatic nut runner 38 powered by air through an air line 39 has a square drive stub 41 that plugs into a square fitting 40 in the side of the torque multiplier 30 to provide the input torque to drive the nuts 37. Alternatively, the nut runner 38 and the torque multiplier 30 could be combined in a single unit. The combination, whether as separate items working together or as a single unit will be referred to as a "driver" herein.

Figure 3:
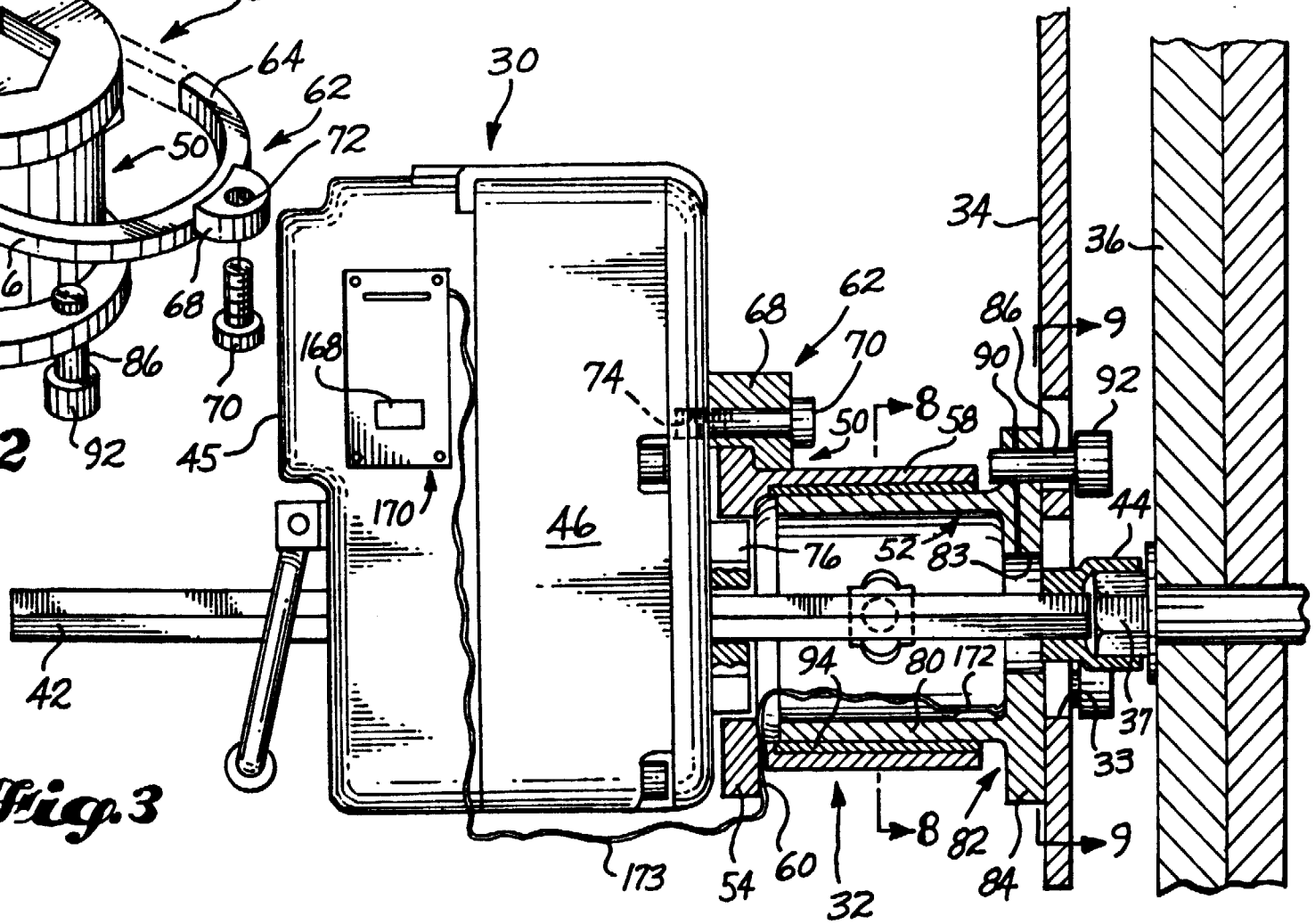
FIG. 3 is a elevation, partially in section, of the adaptor and torque multiplier shown in FIG. 1.

As shown in FIG. 3, the output from the torque multiplier 30 is exerted through a square drive rod 42 to a socket 44 which is placed over and drives the nut 37. A gauge 45 on the top face of the torque multiplier 30 enables the operator to monitor the torque applied to the fastener and turn off the nut runner 38 when the specified torque has been reached.

The torque exerted by the torque multiplier 30 on the drive rod 42 and through the nut 37 to the workpiece 36 is reacted through the housing 46 of the torque multiplier. This reaction torque must be transmitted somehow back to the workpiece 36. For low torque applications, the reaction torque is transmitted through the operator to the floor and hence back to the workpiece, but in high torque applications the torque is to great for the operator to withstand, so a mechanical path must be provided to transmit the reaction torque back to the workpiece. Such a mechanical path is provided by the adaptor 32 and reaction structure of this invention.

Figure 2:
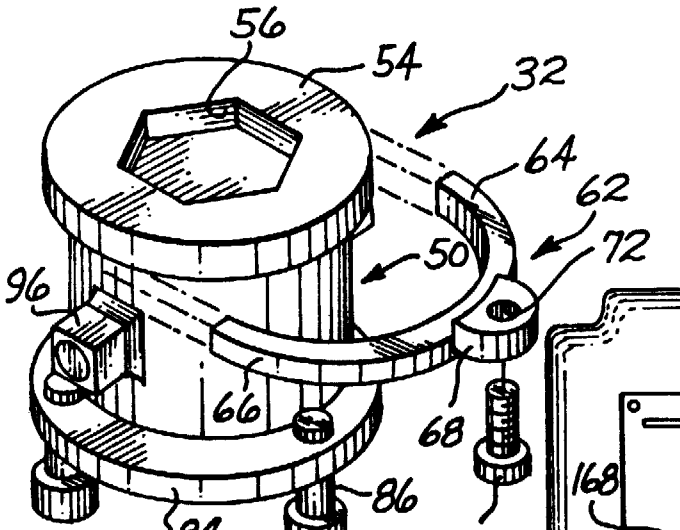
FIG. 2 is a perspective view of the adaptor shown in FIG. 1 with an attachment fork shown broken away.
Figure 5:
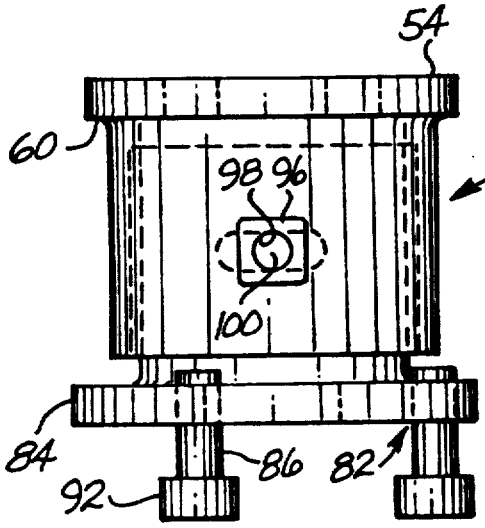
FIG. 5 is an elevation of the adaptor shown in FIG. 2.
Figure 6:
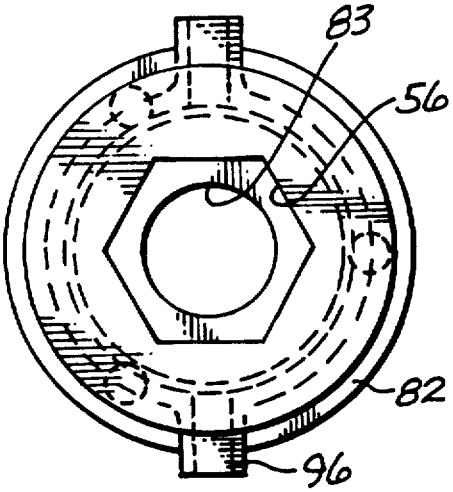
FIG. 6 is a plan view from the top of the adaptor shown in FIG. 2.
Figure 4:
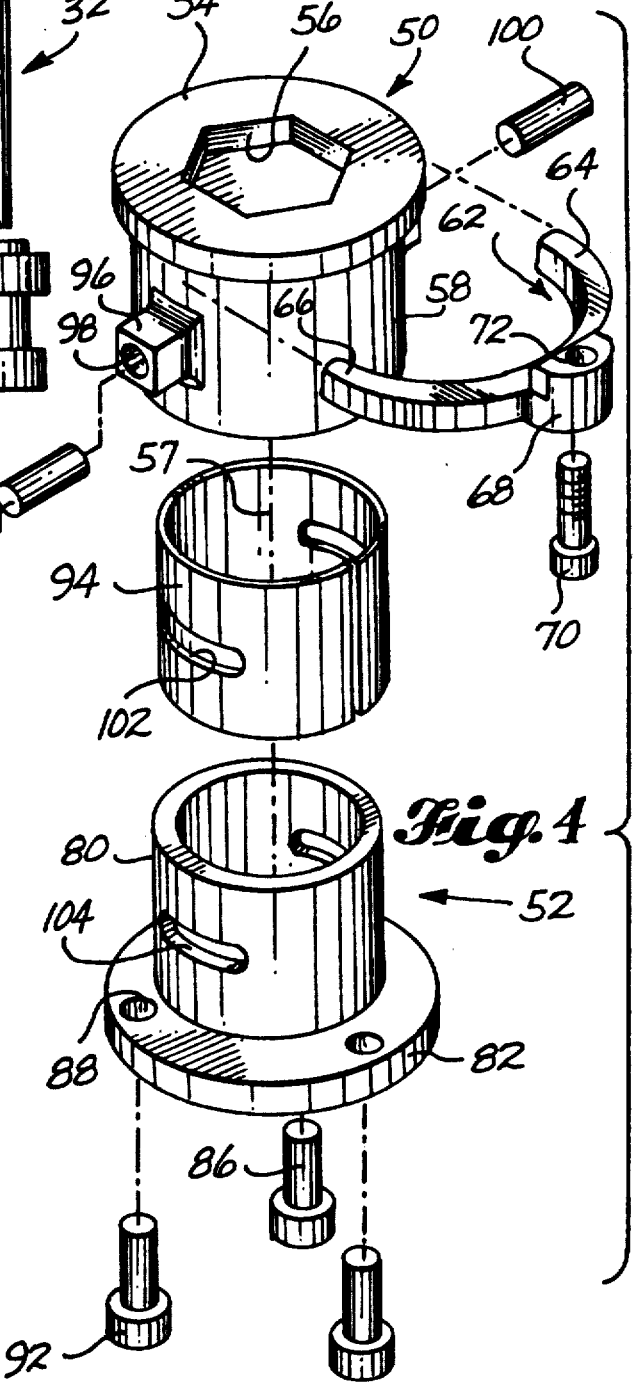
FIG. 4 is a exploded perspective view of the adaptor shown in FIG. 2.

As shown in FIG. 2, the adaptor 32 includes a first or top cylindrical barrel portion 50 which is telescopically nested over a second or bottom cylindrical barrel portion 52 shown in FIG. 3 and most clearly in FIG. 4. The terms top and bottom refer to the orientation of the device shown in FIGS. 2 and 4, but the device can actually be used in any orientation, therefore these terms top and bottom are only for descriptive convenience herein and are not to be given any limiting effect in the attached claims.

The top barrel portion 50 includes a top plate 54 which is welded or integrally formed on the top rim of the top barrel portion 50. The barrel portion 50 is easily lathe turned and then heat treated because of its cylindrical shape, so integrally forming the top plate 54 on the barrel portion 50 in most cases will be the preferred manufacturing process. The top plate 54 has a hexagonal hole 56 therethrough oriented coaxially with the longitudinal axis 57 of the nested barrels 50 and 52. The diameter of the top plate 54 is larger than the outside diameter of the cylindrical body 58 of the top barrel portion creating an overlapping shoulder 60 on the underside of the top plate 54 where it extends beyond the diameter of the cylindrical body 58.

The top barrel portion 50 is attached to the torque multiplier 30 by a fork 62 which has a pair of curved arms 64 and 66, joined at the center to a central hub 68.

As shown in FIG. 2, the arms 64 and 66 straddle the body 58 below the shoulder 60 formed by the junction of the top plate 54 and the body 58. A screw 70 is received in a hole 72 in the hub 68 and is threaded into a threaded hole 74 in the housing 46 of the torque multiplier 30 to hold it to the adaptor 32. A hexagonal boss 76 on the bottom face of the housing 46 fits into the hexagonal hole 56 to provide a torque transmission path between the housing 46 of the torque multiplier 30 and the adaptor 32.

The bottom barrel portion 52 includes a cylindrical body 80 nested within the cylindrical body 58 of the top barrel portion 50. A bottom plate 82, welded or integrally formed on the bottom of the cylindrical body 80, has an axial hole 83 for passage of the drive rod 42 when the adaptor and torque multiplier are secured to the reaction plate 34, as will be discussed below. The bottom plate 82 projects radially beyond the outside diameter of the body 80 to form a projecting peripheral flange 84 in which a series of connectors, such as, three headed pegs 86 are mounted in equally spaced holes 88 for connecting the bottom barrel portion 52 to the reaction plate 34, and for transmitting the reaction torque from the adaptor 32 tot he reaction plate 34. Three pegs are used in the preferred embobiment, but two pegs would suffice, provided that the size and material of the pegs was selected to bear the torque which the device is designed to transmit. For higher torque applications, four or more pegs could be used. The pegs 86 can be fixed in the holes 88 by roll pins 90 or, if the adaptor 32 is made of steel, the pegs 86 can be pressed into the holes 88 with an interference fit which will suffice to hold them in place. The pegs 86 are inserted into the holes 88 far enough to leave a space between the heads 92 of the pegs 86 and the bottom surface of the bottom plate 82 to accommodate the thickness of the reaction plate 34 when the adaptor is mounted thereon, as will be described below.

A sleeve bearing 94 is disposed coaxially between the cylindrical body 58 of the top barrel portion 50 and the cylindrical body 80 of the bottom barrel portion 52. The sleeve is press fit into the top barrel portion 50 and has a low friction coating on the inside surface of the sleeve to receive with a sliding fit the cylindrical body 80 of the bottom barrel portion 52. This insures that the bottom barrel portion 52 can rotate within the top barrel portion 50 to the extent permitted by the rotation limiting means to be described below.

Two bosses 96, shown in cross section in FIG. 8, are formed on diametrically opposed sides of the cylindrical body 58 of the top barrel portion 50, and a hole 98 is drilled radially through each boss 96 and the cylindrical body 58 of the top barrel portion 50. A pin 100 is pressed into each hole 98 and projects inwardly beyond the inner peripheral surface of the cylindrical body 58 and through an elongated slot 102 cut through each side of the cylindrical sleeve bearing 94 and into a elongated slot 104 cut through each side of the cylindrical body 80 of the bottom barrel portion 52. The pins 100 provide limits on the relative rotation of the top barrel portion 50 relative to the bottom barrel portion 52 so that the top barrel portion 50 may be rotated within an arc of about 30°–40° to facilitate mounting of the adaptor 32 on the reaction plate 34, as will be described below. After reaching the limit of free rotation of the top barrel portion 50 relative to the bottom barrel portion 52, permitted by travel of the pins 100 in the slots 102 and 104, a torque transmitting relationship will exist between the two barrel portions of the adaptor by engagement of the pins 100 with the ends of the slots 104.

As shown in FIG. 9, each hole 33 in the reaction plate 34 is surrounded by adjacent openings such as three double keyhole slots 106, each of which has a large diameter center hole 108, slightly larger than the diameter of the heads 92 of the pegs 86, and two narrow diameter slots 109, each slightly larger in diameter than the diameter of the pegs 86, extending from diametrically opposed sides of the center hole 108. The double keyhole slots 106 are use to secure the adaptor 34 to the reaction plate by inserting the heads 92 of the pegs 86, projecting from the flange 82 a distance equal to slightly more than the thickness of the reaction plate 34, through the wide diameter center holes 108 of the three double keyhole slots 106, and rotating the flange 82 in the direction opposite to that which the rod 42 will drive the fastener 37. This shifts the heads 92 of the pegs 86 under the narrow diameter end slots 109 to secure the adaptor 30 to the reaction plate 34. Double keyhole slots 106 are used in the preferred embodiment because they are convenient for driving the fastener in either direction. However, a single sided keyhole slot, in the conventional form having only one small diameter slot 109 projecting from one side of the center hole 108, may be used for applications where the fasteners 37 will be driven predominately only in one direction. Also, when the fasteners 37 are in a straight line, the series of three double keyhole slots around each hole 33 can be replaced by one long keyhole slot extending down along each side of the line of holes 33. Two pegs would be used on the adaptor and would be slid down the elongated slots, sliding the adaptor from hole 33 to hole 33 as the fasteners are tightened. The reaction torque would be exerted by the pegs against the edges of the elongated slots instead of the ends of the individual slots 109, as illustrated in FIG. 9.

Figure 10:
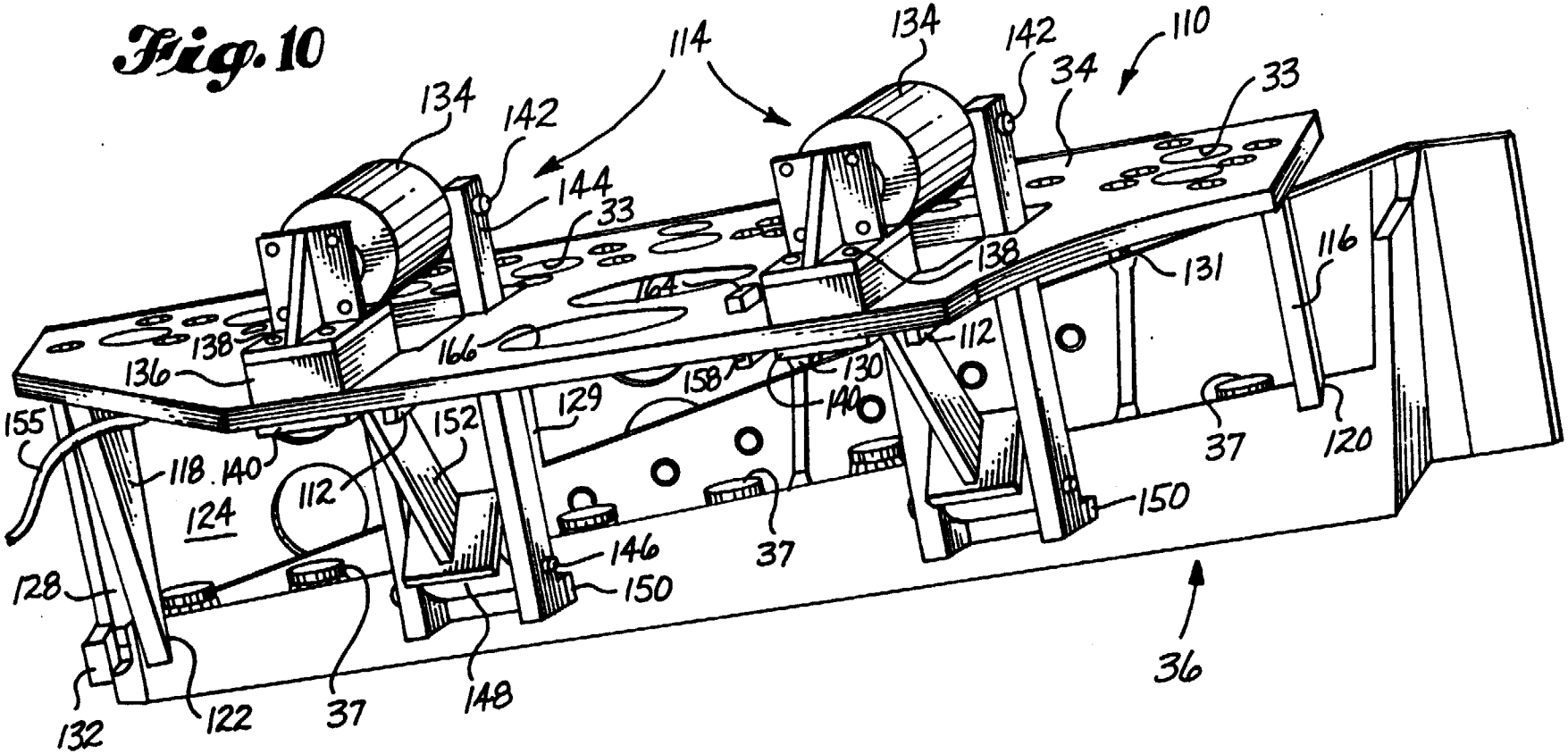
FIG. 10 is a perspective view of a reaction structure according to this invention, shown clamped on a workpiece.

Turning now to FIG. 10, a reaction structure 110 is shown clamped to the workpiece 36. The reaction, structure 110 includes the reaction plate 34 and a series of locating stops (which will be individually described below) for positioning the reaction plate 34 over the workpiece 36. Two L-shaped stiffening bars 112 are fastened to the underside of the reaction plate 34, with the leg of the stiffening bars (not shown) extending downwardly from the reaction plate 34 for support of a back plate, to be described below. A clamping structure 114 is mounted through the reaction plate 34 for clamping the reaction structure 112 to the workpiece 36.

The positioning stops include two triangular bars 116 and 118 fastened to and depending from the underside of the reaction plate 34. The bars 116 and 118 each has a notch 120 and 122, respectively, at its lower end for resting on the peripheral edge of the workpiece 36. The bars 116 and 118 thereby provide both vertical or elevational positioning of the reaction plate 34 relative to the workpiece 36 and also lateral positioning relative to the workpiece 36.

A back plate 124 is securely fastened to the back edge 126 of the reaction plate 34. The back plate carries a series of four positioning bars 128, 129, 130 and 131, each of which has a notch that, like the notches 120 and 122 on the bars 116 and 118, provide a shoulder which can rest on the edge of the workpiece 36 to provide both vertical and lateral positioning of the reaction structure 110 on the workpiece.

A longitudinal stop 132 is attached at the end of the reaction structure 110 to the end edge of the back plate 124 to provide a longitudinal positioning stop to facilitate the longitudinal positioning of the reaction structure 110 on the workpiece 36.

The clamping structure 114, shown in FIGS. 1 and 10, includes a pair of single-acting, spring return air cylinders 134 which are pinned at one end to a base structure 136 which is adjustably fastened to the reaction plate 34 by a series of screws 138 which pass through the base structure 136 and are threaded into a back up plate 140. The other end of each of the air cylinders 134 is pinned to 142 to the upper ends of a double arm 144, the lower end of which is pinned at 146 to a fulcrum block 148 disposed between the lower ends of the double arm 144. The pin 146 acts as a fulcrum for the double arm 144 about which the arm pivots to rotate a shoe 150 made of hard rubber or the like against the edge of the workpiece 36 to effect the clamping of the reaction structure 110 to the workpiece. The fixed position of the fulcrum block 148 is established by a diagonal brace bar 152 which is fastened as by welding between the backup plate 140 and the top of the fulcrum block 148.

The force exerted by the shoe 150 is resisted on the other side of the reaction structure by the back plate 124, stiffened by the depending leg (not shown) of the stiffening bars 112. The resisting force exerted by the back plate 124 acts through the laterally facing edges of the notches on the bars 128, 129, 130 and 131. Thus, the positioning bars 128 through 131 serve the triple role of elevational positioning of the reaction plate 34, lateral positioning of the reaction plate 34 on the workpiece 36, and reaction clamp-up force to oppose the clamping force of the shoes 150 on the double arms 144 exerted by the air cylinders 134.

The power and control system for operating the clamping air cylinders 134 is shown schematically in FIG. 11. Air under pressure from an air pressure source 154 is delivered via an air supply line 155 and a quick disconnect fitting 157 to a check valve 156, which can be physically part of the structure of the fitting 157. The air passes from the check valve 156 to an air toggle switch 158 through an air line 159. The air toggle switch 158 is a two position switch, in one position of which it connects the line 159 from the check valve 156 and the source of air pressure 154 to an air line 160 leading to the air cylinders 134. In the other position of the air toggle switch 158, the air line 160 from the air cylinders 134 is connected to a vent 162 which vents the air from the cylinders 134 to atmosphere to allow the return spring in the cylinders 134 to retract the pistons and release the clamping force on the pads 150.

The switch 158 is mounted on the underside of the reaction plate 34 at a position between the two air cylinders 134. The switch toggle extends above the top surface of the reaction plate 34 and is covered by a hinged cover 164 which protects the toggle of the switch 158 from being accidentally triggered which could cause unintended release of the reaction structure 110 from the workpiece 36.

In operation, the reaction structure is lifted onto the workpiece and the stops are fitted onto the workpiece edges to accurately locate the reaction plate over the workpiece 36 so the holes 33 in the reaction plate are aligned with the fasteners 37 and so the clamp shoe 150 is in position to clamp the reaction structure 110 to the workpiece. The toggle switch 158, which is adjacent to a lightening hole 166 near the right edge of the reaction plate 34, as seen in FIG. 10, and which provides a convenient hand-hold for lifting the reaction structure 110 into place, is toggled by the operator's thumb to deliver air pressure from the air line 155 to the cylinders 134 to actuate the clamp and secure the reaction structure 110 to the workpiece 36.

A socket 44 is selected to fit the fastener 37, and the drive rod 42 is inserted in the driven receptacle of the socket 44. The socket 44 is inserted through the hole 33 and is placed over the fastener 37, which is in plain sight of the operator through the hole 33. The torque multiplier 30, with the attached adaptor 32, is fitted onto the drive rod 42, so the drive rod extends through the hole 83 in the bottom plate 82 of the adaptor 32 and into the torque multiplier 30 as shown in FIGS. 1 and 3. The flange 84 of the bottom barrel portion 52 of the adaptor 32 is rotated to align the heads 92 of the pegs 86 with the center large diameter portion 108 of the double keyhole slots 106, and the heads 92 of the three pegs are inserted into the double keyhole slots 106. The flange 82 is rotated, in the direction opposite to the direction that the drive rod 42 will rotate to drive the fastener, to shift the heads 92 under the narrow diameter end slots 109 to secure the adaptor on the reaction plate 34. Alternatively, the rod 42 can first be inserted into the torque multiplier and the socket fitted onto the end of the rod 42. The socket 44 is then fitted onto the nut 37 and the torque multiplier 30 and the top barrel 50 can e rotated to align the peg heads 92 with the center portion 108 of the double keyhole slots 106. The adapter is secured to the reaction plate 34 by rotating in the opposite direction from the driving direction of the rod 42, in the same manner as noted above.

The square drive stub 41 of the nut runner 38 is now inserted into the square receptacle 40 on the torque multiplier, and power is applied to the nut runner 38. The torque exerted by the nut runner 38 is multiplied by the torque multiplier 30 and is applied to the fastener 37 through the drive rod 42 and the socket 44. The operator watches the gauge 45 on the torque multiplier 30 and, when the gauge indicates that the specified torque has been reached, the operator turns off the nut runner 38. The operator now watches the gauge for a minute or so to see if the joint will "relax," which is indicated by a decrease in the torque reading on the gauge 45. If the joint "relaxes," the operator waits until the rate of decline has begun to taper off, and then he restarts the nut runner 38 to redrive the fastener back up to the specified torque, and again monitors the gauge 45. If the torque again declines, the operator repeats the retorquing step until the torque on the fastener as indicated by the gauge 45 is stable. The operator then presses a button 168 on a printer 170 which can be mounted conveniently on the side of the housing 46 of the torque multiplier 30 to record the torque on that fastener as indicated by a strain gauge 172 connected to the printer 170 by a wire 173, or as indicated by the torque sensor in the torque multiplier 30. This creates a permanent record of the torque applied to that fastener which can be used for statistical process control and makes the presence of a quality control monitor unnecessary. The torquing of that fastener is now complete, and the operator reverses the direction of the torque applied by the nut runner 38 to release the locking pressure exerted by the pegs 86 in the double keyhole slots 106, and removes the adaptor from the first hole 33. He repeats the process for the next fastener and all the other fasteners on the part 36 until they are all properly torque and the final torque on each is recorded. He then removes the adaptor 32 and the torque multiplier from the reaction structure 110 and flips open the toggle cover 164. He grasps both sides of the reaction plate 34, then toggles the switch 158 open to release the clamps 114, and removes the reaction plate from the workpiece 36.

The invention thus provides a fast, reliable and repeatable system for applying high torque to fasteners with a process and apparatus that is easy to use, requires only one operator, and provides a permanent accurate record of the torque that was applied to each fastener. The system uses inexpensive, easily machined parts that do not require expensive precision machining, and it is extremely durable.

Obviously, numerous modifications and variations of the preferred embodiment described herein will occur to persons skilled in the art in view of this disclosure. Accordingly, it is expressly to be understood that these modifications and variations, and the equivalents thereof, may be practiced while remaining within the spirit and scope of my invention as defined in the following claims.

I claim:

1. A device for coupling a torque driver, having a housing and a drive rod adapted to engage a drive socket, to a fastener in a workpiece for applying torque to said fastener through said socket, and for reacting the reaction torque from said driver housing to said workpiece, comprising:

an adaptor for connecting said driver housing to said workpiece, said adaptor including structure for torsionally connecting said driver housing to said workpiece for transmitting said reaction torque from said driver housing to said workpiece, and having a passage to accommodate said drive rod extending from said driver to said socket for torsionally linking said drive rod to said fastener for driving said fastener on said workpiece;

said adaptor structure including a first portion for connection to said driver housing, and a second portion for connection to said workpiece; and a coupling for connecting said first and said second portions of said adaptor structure together for free rotation within set limits relative to each other to facilitate engaging said socket on said driver rod with said fastener, and for transmitting torque from said first portion to said second portion at said limit of said free rotation for transmission of said reaction torque from said housing to said workpiece.

2. A device as defined in claim 1, further comprising:

a reaction plate having a series of holes therethrough for receiving said drive rod, and openings adjacent to said holes for receiving connectors for mounting said second portions on said reaction plate over any desired one of said holes, and for transmitting torque from said second portion to said reaction plate; and structure for securing said reaction plate to said workpiece.

3. A device as defined in claim 2, wherein:

said securing structure includes a clamp attached to said plate for releasably clamping one side of said plate against a first fixed stop on said workpiece; and an abutment on said plate at a position on said plate opposite to said clamp attachment, for bracing against a second fixed stop on said workpiece facing in the opposite direction from said first fixed stop.

4. A device for coupling a torque driver, having a housing and a drive rod adapted to engage a drive socket, to a fastener in a workpiece for applying torque to said fastener through said socket, and for reacting the reaction torque from said driver housing to said workpiece, comprising:

adaptor means for connecting said driver housing to said workpiece, including means for torsionally connecting said driver housing to said workpiece, and means for torsionally linking said drive rod to said fastener for driving said fastener on said workpiece;

said adaptor means including means for reacting the reaction torque from said driver housing to said workpiece;

said adaptor means including a first portion for connection to said driver housing, and a second portion for connection to said workpiece;

means coupling said first and said second portions together for limited rotation relative to each other to facilitate engaging said socket on said driver rod with said fastener;

said torque reacting means including a reaction plate having means for mounting said second portion thereon;

means for securing said reaction plate to said workpiece;

said mounting means includes a plurality of keyhole slots spaced around an opening in said reaction plate, said slots being positioned to align with a plurality of headed pegs on said second portion which can be fit into said slots and are then secured by rotating said second section to shift said heads of said pegs behind a narrow end portion of said slots.

5. A device for coupling a torque driver, having a housing and a drive rod adapted to engage a drive socket, to a fastener in a workpiece for applying torque to said fastener through said socket, and for reacting the reaction torque from said driver housing to said workpiece, comprising:

adaptor means for connecting said driver housing to said workpiece, including means for torsionally connecting said driver housing to said workpiece, and means for torsionally linking said drive rod to said fastener for driving said fastener on said workpiece;

said adaptor means including means for reacting the reaction torque from said driver housing to said workpiece;

said adaptor means including a first portion for connection to said driver housing, and a second portion for connection to said workpiece;

means coupling said first and said second portions together for limited rotation relative to each other to facilitate engaging said socket on said driver rod with said fastener;

said coupling means including a pair of diametrically opposed pins mounted in said first portion of said adaptor means; and a pair of diametrically opposed elongated slots in said second portion of said adaptor means, said second portion being telescopically disposed within said first portion with said elongated slots each aligned with and receiving an inner end of one of said pins;

whereby said first portion can rotate relative to said second portion to facilitate engagement of said socket with said fastener, whereupon said driver can be started to drive said drive rod in one direction and, by reaction, drive said first portion in the opposite direction until said pins engage the ends of said elongated slots to transmit reaction torque from said first portion to said second portion and thence to said workpiece.

6. A device as defined in claim 5, wherein:

said pins are mounted in bosses projecting from the sides of said first portion.

7. A device as defined in claim 5, further comprising:

a bearing sleeve interposed between said first and second portions of said adaptor means.

8. A device as defined in claim 7, wherein:

said first portion includes a cylindrical body having a top plate and an open bottom;

said torsional connecting means includes a hexagonal hole in said top plate sized to receive a hexagonal boss on said driver housing with a driving fit, whereby reaction torque from said driver housing is transmitted to said first portion.

9. A device as defined in claim 8, wherein:

said second portion includes a cylindrical body sized to fit within said cylindrical body of said first portion, and a base plate attached to the lower end of said second portion;

said torque reacting means includes a reaction plate having means for mounting said second portion thereon, and means for securing said reaction plate to said workpiece;

said mounting means includes a plurality of double keyhole slots spaced around an opening in said reaction plate for passage of said drive rod between said driver and said fastener, said slots being positioned to align with a plurality of headed pegs mounted on said base plate and positioned thereon to fit into said slots and then be secured by rotating said second portion to shift said heads of said pegs behind a narrow end portion of said slots.

10. A device as defined in claim 9, wherein:

said bearing sleeve is pressed into said first portion of said adaptor means to fit snuggly therein; and said second portion is slidably recieved in said bearing sleeve for low friction limited rotational motion therein.

11. A device as defined in claim 10, wherein:

said bearing sleeve has a low friction surface on the inner surface thereof to provide a low friction interface between said first and second portions of said adaptor means.

12. A process for torquing a fastener on a workpiece, comprising:

attaching a driver to a first portion of an adaptor in torque transmitting relationship thereto;

attaching a reaction plate to said workpiece in torque transmitting relationship thereto;

attaching a second portion of said adaptor to said reaction plate in torque transmitting relationship thereto, said second portion of said adaptor being coupled to said first portion of said adaptor for limited free rotation relative thereto, and in torque transmitting relationship thereto after said free rotation limit has been reached;

connecting a socket, mounted on an end of a drive rod drivingly coupled to said driver, to said fastener by placing said socket over said fastener and rotating said first portion of said adaptor relative to said second portion to cause said socket to register with said fastener;

operating said driver to drive said fastener in said workpiece; and reacting the reaction torque from said driver through said first portion of said adaptor, through said coupling between said first and second portions of said adaptor, through said second portion of said adaptor, through said reaction plate, and into said workpiece.

13. A process as defined in claim 12, further comprising:

watching a gauge on said driver that indicates the magnitude of torque applied by said driver to said fastener; and turning off said driver when said gauge indicates that the desired torque has been reached.

14. A process as defined in claim 13, further comprising:

waiting until relaxation of said joint is substantially complete, as indicated by a tapering off of the rate of decrease of said torque on said fastener, indicated on said gauge; and retorquing said fastener by restarting said driver and operating said driver until said gauge again indicates that the desired torque has been achieved.

15. A process as defined in claim 12, wherein:

said step of attaching said second portion of said adaptor to said reaction plate includes inserting a plurality of headed pegs attached to said second portion through a correspondingly spaced plurality of double keyhole slots, and rotating said second portion of said adaptor to shift said heads of said pegs behind the narrow portion of said double keyhole slots, in the direction that the driver will be operated to drive said socket.

16. A reaction structure for coupling an adaptor, to which a torque multiplier is attached, to a workpiece on which said torque multiplier is to drive a series of fasteners spaced along said workpiece, comprising:

a reaction plate having a plurality of holes therein positioned to correspond with the location of said fasteners on said workpiece;

at least one longitudinal locating stop attached to said plate for engaging a portion of said workpiece and thereby facilitating the positioning of said plate at the correct position longitudinally on said workpiece;

at least one elevation positioning stop attached to said plate for engaging a portion of said workpiece and thereby facilitating the placement of said plate at the correct elevation relative to said workpiece;

at least one lateral positioning stop attached to said plate for engaging a portion of said workpiece and thereby facilitating the placement of said plate at the correct position laterally relative to said workpiece;

a power operated clamp attached to said plate and having a foot powered by said clamp for exerting a force against one side of said workpiece;

a brace attached to said plate on the side of said plate opposed to said clamp for resisting said force exerted by said foot, whereby said plate is held to said workpiece by the squeezing force exerted between said foot and said brace;

a plurality of double keyhole slots spaced equally around each of said plurality of holes to accomodate a correspondingly spaced plurality of headed pegs on an adaptor, to which a driver can be mounted, to facilitate the rapid placement and connection of said adapter on said plate for applying torque to said fasteners;

whereby a driver may be mounted to said adaptor and connected to said plate by the pegs on the adaptor fitted into said double keyhole slots, and the driver may be connected to said fastener and apply torque to said fastener while reaction torque reacted through the driver housing and the adapter to the reaction plate is transmitted therethrough by said clamp and said brace to said workpiece.

17. A reaction structure as defined in claim 16, wherein:

said power operated clamp includes at least one air cylinder controlled by a switch mounted on said reaction plate, said air cylinder having one end linked to said reaction plate and the other end linked to said foot.

18. A reaction structure as defined in claim 17, wherein:

said air cylinder is of the single acting, spring return type; and said switch is a two position toggle type switch, one position of which connects said air cylinder to a source of air pressure, and the other position of which vents said air cylinder to the atmosphere to permit said spring in said air cylinder to return said cylinder to the retracted position thereof to release said clamp.

19. A reaction structure as defined in claim 17, further comprising:

a check valve between said source of air pressure and said switch to prevent a failure of said air pressure source from causing said clamp to release said reaction structure from said workpiece.

20. A reaction structure as defined in claim 17, further comprising:

a lever having one end attached to other end of said air cylinder, and pivotally attached to said reaction structure near the other end of said lever;

a pressure foot attached to said other end of said lever and having a pressure pad attached thereto, said pressure pad disposed to apply pressure against said workpiece when said air cylinder is pressurized to rotate said lever about its pivotal attachment to said reaction structure to apply pressure against said workpiece to hold said reaction structure to said workpiece.

* * * * *